United States Patent [19]

Laufenburg et al.

[11] Patent Number: 4,848,811

[45] Date of Patent: Jul. 18, 1989

[54] WING FRAME FOR A WINDOW, DOOR OR THE LIKE WITH A CLUTCH SLIDE AND CONNECTING ROD

[75] Inventors: Willi Laufenburg, Wilnsdorf; Alfred Schneider, Kreuztal, both of Fed. Rep. of Germany

[73] Assignee: Siegenia-Frank KG, Siegen, Fed. Rep. of Germany

[21] Appl. No.: 150,624

[22] Filed: Feb. 1, 1988

[30] Foreign Application Priority Data

Mar. 27, 1987 [DE] Fed. Rep. of Germany ..... 3710056
Nov. 11, 1987 [DE] Fed. Rep. of Germany ..... 3738300

[51] Int. Cl.[4] ..... E05C 1/06

[52] U.S. Cl. ..... 292/142; 292/39; 292/160; 292/DIG. 53

[58] Field of Search ..... 292/22, 39, 51, 142, 292/112, 160, 172, 199, 279, 280, 337, 336.3, DIG. 53, DIG. 64, DIG. 60; 70/451; 49/192

[56] References Cited

U.S. PATENT DOCUMENTS

| | | | |
|---|---|---|---|
| 4,002,360 | 1/1977 | Frank et al. | 292/142 |
| 4,002,361 | 1/1977 | Laufenburg | 292/336.3 |
| 4,420,905 | 12/1983 | Kucharczyk | 49/192 |
| 4,616,864 | 10/1986 | Douglas | 292/39 |
| 4,624,075 | 11/1986 | Vigreux | 49/192 |
| 4,637,165 | 1/1987 | Schneider | 49/192 |

FOREIGN PATENT DOCUMENTS

| | | | |
|---|---|---|---|
| 124460 | 11/1984 | European Pat. Off. | 292/22 |
| 7108093 | 6/1971 | Fed. Rep. of Germany . | |
| 1708168 | 9/1971 | Fed. Rep. of Germany . | |
| 2515989 | 10/1976 | Fed. Rep. of Germany | 292/39 |
| 2725982 | 1/1978 | Fed. Rep. of Germany | 292/39 |
| 3300423 | 7/1984 | Fed. Rep. of Germany | 292/39 |
| 3300976 | 7/1984 | Fed. Rep. of Germany | 292/39 |
| 3600211 | 5/1987 | Fed. Rep. of Germany | 292/39 |

*Primary Examiner*—Gary L. Smith
*Assistant Examiner*—Eric K. Nicholson
*Attorney, Agent, or Firm*—Blodgett & Blodgett

[57] ABSTRACT

In a wing frame 1 for windows, doors, or the like, composed of metal or plastics profiles, the actuation gear assembly 10 for a connecting rod 9 is so housed that adjacent an undercut profiled guide channel 5 for the connecting rod 9, an installation space is required which corresponds to only a fraction of the maximal cross-sectional height 23 of the gear housing 13. For this purpose the bottom 8 of the guide channel 5 is provided with a perforation 27 through which can be passed the first housing section 15, which stores the pinion 14 of the actuation gear assembly 10.

17 Claims, 7 Drawing Sheets

WING FRAME FOR A WINDOW, DOOR OR THE LIKE WITH A CLUTCH SLIDE AND CONNECTING ROD

BACKGROUND OF THE INVENTION

The invention relates to a wing frame for a window, a door, or the like, where at least the wing frame is composed of metal or plastics profiles which have a profiled guide channel at their guide channel surface which is open on one side, but undercut at both sides in transverse direction for the lengthwise taking up of a connecting rod. The connecting rod located in the guide channel can be coupled from its open side with an actuation gear assembly which displays a driving element, e.g., a pinion. The gear is supported in a housing. It is rotatingly operable by means of a control handle. Furthermore, the housing of the actuation gear assembly is braced from the open side of the guide channel at the metal or plastics profile and is mounted thereon by bolting. The control handle is engaged from the roomward face of the wing frame with a polygonal arbor, for example, a square or hexagonal arbor, by means of a hole in the metal or plastics profile in a correspondingly profiled dog recess of the driving element and held in engagement with it by means of bolting.

As shown in the German Pat. No. 1708168 it is known in the art to use a mounting of this type on windows, doors, or the like, which mounting consists at least of a connection rod and an actuation gear which likewise displays the features of the indicated type.

A disadvantage of the prior known mounting, however, is that its actuation gear must be mounted totally at the guide channel side of the wing of the window, the door, or the like, before the undercut, profiled guide channel for the connecting rod. This is because the connecting rod, in order to fulfill its intended task, must pass in the undercut profiled guide channel through a relatively long regulating distance (for example between 35 mm and 40 mm), and since the angle of rotation for the control handle of the actuation gear may amount at most to 180°, the necessary diameter of the pivotably drivable driving element requires a relatively large installation space for the actuation gear before the guide channel surface of the wing which contains the guide channel. The free space required for the installation of the know actuation gear assembly before the guide channel surface of the wing frame containing the guide channel amounts, even in the most favorable case, to at least 20 mm. Such a free space is not as a rule available on the currently customary design of the metal or plastics profiles.

It is a primary object of the invention to provide a window, a door, etc., or the like, of the initially described type wherein the associated connecting rod mounting (where the guide channel surface of the wing frame is equipped with an undercut, profiled guide channel) can be accommodated, for installation space for the actuation gear assembly of the connecting rod mounting, in such space as is readily available on the customary profile design. The free space required before the guide channel surface of the wing for the installation of the actuation gear assembly has a measure of about 10 mm or not greatly to exceed this measure in a direction parallel to the plane of the wing.

SUMMARY OF THE INVENTION

This object is accomplished basically in one aspect of the invention by the fact that at least the metal and/or plastics profile of the wing frame is provided with a perforation in the installment location of the actuation gear, that the perforation penetrates the bottom of the metal and/or plastics profile at the wing frame, that the first housing section of the actuation gear which supports the driving element extends through the perforation in the bottom of the guide channel, while a second housing section of the actuation gear assembly (which lengthwise guides a clutch slide in constant engagement with the driving element) is held against the open side of the guide channel at the metal and/or plastics profile, that the length of the notch in the connecting rod is dimensioned by adding the maximal regulating distance of the clutch slide to the length of the perforation in the bottom of the guide channel at the metal or the plastics profile, that the clutch slide has at both ends lug extensions projecting rearwardly from a slotted aperture in the second housing section of the actuation gear assembly guiding it, which can be engaged in appropriate lug recesses at the connection rod, and that the second housing section of the actuation gear assembly which supports the driving element, is provided at least upon one side but preferably on both sides of the driving element with a threaded engagement for threaded fasteners upon a plane extending parallel to the direction of motion of the clutch slide, going through the axis of the rotation of the driving element. These engagements also reach through a bearing collar associated with the control handle which is braced at the roomward face of the wing frame.

From these improvements in this kind of window, door, or the like and the associated driving rod mounting there results the advantage that metal or plastics profiles of customary kinds can be readily used; i.e., those which have at their guide channel surface a profiled guided channel (for the lengthwise shiftable taking up of connecting rods) which is open on one side but undercut at both sides in transverse direction. On the other hand, there exists the possibility of using customary control handles which rest on a bearing collar braced at the roomward face of the wing frame. This also avoids the application of constructionally complex and thus expensive grip gears in which all gear elements required for the movement of the connecting rod are accommodated in a housing which stores the control handle and which has to be mounted in toto upon the roomward face of the wing.

It is already known, for example, through DE-GM No. 71 08 093, to use a connecting rod mounting in which the actuation gear penetrates a perforation at the wing frame which is molded directly into the guide channel for windows, doors, or the like, in which at least the wing frame is composed of plastics profiles. Here also a customary control handle interacts with the actuation gear which is held in a bearing collar braced at the roomward face.

On this known window or door, however, the guide channel provided on the guide channel surface of the wing frame in the plastics profile is generally provided with the stepped but not undercut profiling customary for wooden windows. Also, the actuation gear assembly is equipped directly, in the manner customary for wooden window mountings, as an integral structural part with a connecting rod, with a U-rail guiding and covering it, and with locking elements mounted in the connecting rod and guided in the U-rail. It is therefore a connection rod mounting of a different species.

As a further aspect of the invention, the rotation axis of the driving element and the engaging threads lie in the housing of the actuation gear assembly upon one plane which coincides at least approximately with one-half the thickness of the guide channel at the metal or plastics profile. Thus, after making the perforation in the bottom of the guide channel, a support web for the gear housing formed by the bottom wall remains standing at the wing profile which reliably takes up the tension loads of the fastening bolts for the bearing collar of the control handle attached to the gear housing and opposes undesirable deflection of the actuation gear assembly.

Based on experience, the hole for the passage of the polygonal arbor of the control handle and the holes for the passage of the fastening screws of the bearing collar are provided as bore holes which extend through an undercutting area of the guide channel and up to the perforation in the bottom of the channel. These holes can be made in a simple and reliable manner with a so-called multiple-drill head or multiple-cutterhead and permit, in a simple manner, not only the establishment of a positive connection between the control handle and the actuation gear assembly, but also the securing of the actuation gear assembly at the wing frame.

For optimal alignment of the actuation gear assembly at the guide channel surface of the wing frame the second housing section of the actuation gear assembly, which guides the clutch slide is provided at least at its ends with bilaterally projecting supporting claws which can be laid against the front face of the profile portions of the wing frame which define the undercut guide channel.

On windows, doors, or the like of this type it is frequently customary to delay mounting the control handle for the actuation gear assembly on the wing, at least during the storage and transportation of the windows or doors. This is because, on the one hand, it facilitates the stacking capability of the window and door units, and on the other hand, because it also avoids undesirable damage to the control handles. However, in order to ensure the functionally correct mounting position of the actuation gear assembly at the window, the first housing section of the actuation gear assembly which stores the driving element, is provided with a clutch engagement in alignment with the rotation axis of the driving element for a plug socket at its side nearest to the roomward face of the driving element, which socket can be engaged from the roomward face of the wing frame through the aligned drill hole into the clutch engagement.

The clutch engagement can consist of a projecting neck adapted to be embraced by the plug socket, and the plug socket can carry a collar which can be braced on the roomward face of the wing frame. It has proved particularly useful to manufacture the plug socket of a plastic material which engages with a press fit, on the one hand, in the boring in the window frame and, on the other hand, embraces, likewise with a press fit, the neck at the actuation gear assembly.

Another feature of the invention is that the connecting rod is provided in the mounting range of the actuation gear assembly with a notch, the length of which is longer by at least the maximal regulating distance than the perforation in the bottom of the guide channel at the metal and/or plastic profile and that the notch has in the connecting rod a width which is greater than the inside of the opening side of the undercut guide channel and the wing frame, while the width of the perforation in the bottom of the undercut guide channel is made at most equal to the inside width of its opening side.

Preferably, the notch in the connecting rod is made open at one side and the lug recesses are formed by transverse slots offset from the ends of the notch.

It is also preferable that the bearing collar of the control handle engages, at least with approximate fit, in the drill holes at the roomward face of the wing frame by means of locating plugs which are concentrically formed onto the axles of the fastening bolts.

These features of a window, door, or the like of this type and the associated fitting produce the advantage that, on the one hand, metal or plastics profiles of customary type can readily used which have on their guide channel surface a profiled guide channel open on one side but laterally undercut in transverse direction for the lengthwise take-up of movable connecting rods, while, on the other hand, customary control handles can be used which sit in a bearing collar braced on the roomward face of the wing frame. This avoids the use of structurally complex and therefore expensive grip gears in which all the gear elements necessary for the movement of the connecting rod are accommodated in a housing in which the control handle is supported; such a housing would have to be mounted in toto on the roomward face of the wing.

The tank which is the basis of the invention can also be solved by providing, instead of the threaded engagements described above, pairs of profiled webs extending parallel to the guide motion of the clutch slide and lateral projecting from the housing at least in the range of the first housing section of the actuation gear assembly (holding the driving element) on both long sides of the housing, which form in each case an undergripping web and an overlapping web for the edges of the hook flanges at the guide channel in the wing, and that at least on one of the overlap webs, a locking bolt is held under tension and/or guided against a hook flange of the guide channel.

By use of these alternative features the aforementioned advantages are fully realized.

A further aspect of the invention is that the overlap webs of the pairs of profiled webs extend in each case along the second housing section of the actuation gear assembly (that which lengthwise guides the movable clutch slide) preferably over its whole length, while the undergripping webs are solely located adjacent the first housing section (which stores the driving element). By this design the operating forces which are produced at the actuation gear assembly are securely introduced through the gear housing into the wing.

To ensure that a reliable holding engagement of the actuation gear assembly with the wing can be achieved in a simple manner, a further aspect of the invention provides that the space between the bilateral profile-web pairs, which face away from one another, limited in each case by an undergrip web and an overlap web, is dimensioned smaller than the distance between the mutually facing rims of the undercutting or hook flange regions at the guide channel of the wing. Further, the perforation in the bottom of the wing-side guide channel has a width which is at least greater than the maximal thickness of the first housing area of the actuation gear assembly (which stores the driving element) by the difference between these distances.

Because of these features, after introduction of the first housing section (storing the driving element) into the wing-side perforation it is possible to bring the actuation gears under a certain inclination of its plane into engagement, first with the one pair of profiled webs at the rims of its undercutting range, and then to shift it so far laterally that the opposite pair of profiled webs can be set to the height of the rims on the adjacent undercutting range. When the actuation gear assembly is then shifted transverse to its plane in the opposite direction, the second pair of profiled webs comes into engagement with the adjacent undercutting range rims. Following this, the actuation gear assembly can be fixed by tightening the clamping pieces.

For a secure handling of the actuation gear assembly during the mounting process it is preferable that the overlap webs of the profiled-web pairs have a greater profile width than the undergrip webs, at least in the section of the housing range storing the actuation gear assembly.

For the same purposes it is, however, also useful if the smallest inside spacing between the undergrip web and the overlap web of the profile-web pair equipped with the clamping piece is dimensioned larger than the profile thickness of the undercut range rims at the guide channel, while the smallest inside spacing between the undergrip web and the overlap web of the other profiled-web pair correspond closely to the profile thickness of the undercut range rims at the guide channel.

Another aspect of the invention is that the first housing section of the actuation gear assembly (which stores the driving element) is bilaterally offset in a longitudinal direction relative to the second housing section (guiding the clutch slide) in order to form a claw on each side and that the spacing between the base surfaces of both claws is smaller than the length of the perforation in the bottom of the wing-side guide channel, while the spacing between the free ends of both claws corresponds to the length of the perforation.

The last mentioned feature is especially recommendable when the claw sections of the housing section storing the driving element are provided with a threaded engagement for fastening bolts located on a plane extending parallel to the guide motion of the clutch slide, and passing through the axis of rotation of the drive element; at least upon one side—preferably, however, on both sides. The engagements also penetrate a bearing collar supported at the roomward face of the wing frame. The result is a quite particularly stable holding connection of the actuation gear assembly with the wing of the window and door.

Finally, the invention also provides in a further aspect that the second housing section of the actuation gear (lengthwise movably guiding the clutch slide) carries a spring-loaded blocking rocker of a misoperation blocking mechanism which is provided with a blocking leg which can be brought into and out of blocking engagement with blocking elements upon an arm of the clutch slide which projects form the housing section.

BRIEF DESCRIPTION OF THE DRAWINGS

The subject matter of the invention is presented in the drawings using specific embodiments as examples, wherein.

DESCRIPTION OF THE PREFERRED EMBODIMENT

Figure 1:
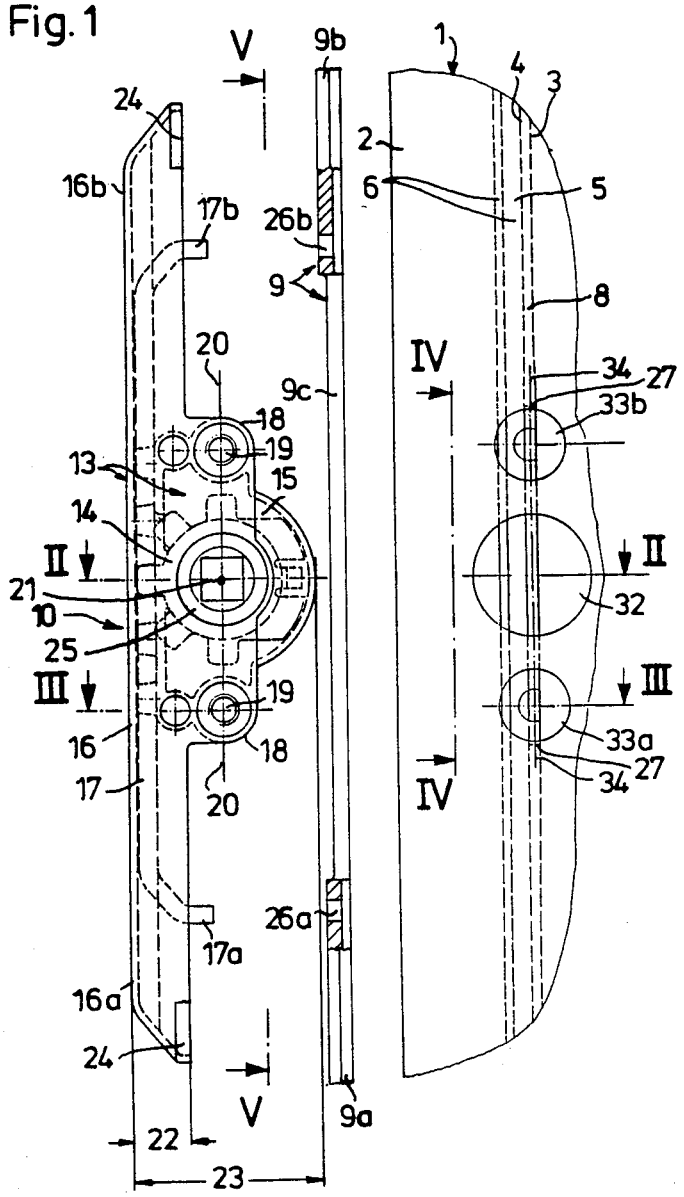
FIG. 1 shows, in front view, a sectional area from the wing frame of a window, a door, or the like with the associated actuation gear assembly of a connecting rod fitting before installation into the wing frame.
Figure 2:
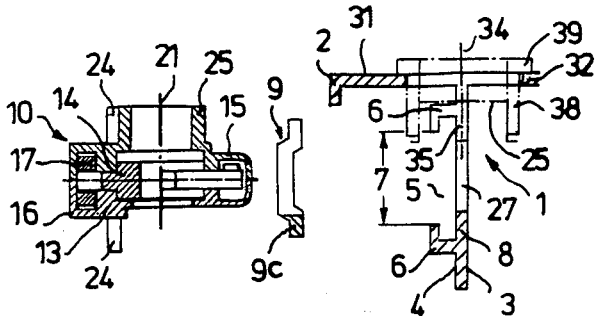
FIG. 2 shows a cut along the line II—II through the actuation gear assembly and the wing frame of FIG. 1.
Figure 3:
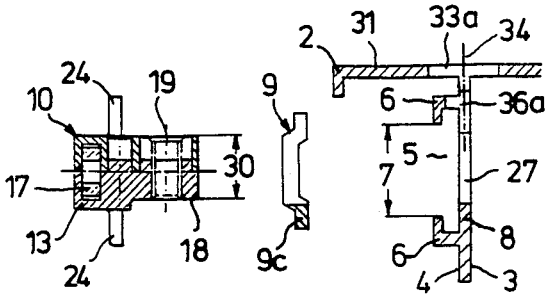
FIG. 3 shows a cut along the line III—III through the actuation gear assembly and the wing frame of FIG. 1.

FIGS. 1–3 present, from a window, a door, or the like (which usually consist of stationary frame and a wing frame) only that cutout section of the wing frame 1 which is essential for the present case. The wing frame 1 is composed of metal or plastics profiles which have been manufactured through continuous pressing or extrusion pressing. Preferably, light-metal profiles are used for the manufacture of the wing frame 1. The light-metal or plastics profiles used for forming the window frame 1 display a transverse section 2 oriented parallel to the wing plane to which a guide channel section 3 joins—essentially under a right angle. This guide channel section 3 is formed by a profile wall, which is provided on its outside (the so-called guide channel face 4) with a profiled guide channel 5 open on one side, but undercut bilaterally in transverse direction. This guide channel 5 is limited on both sides by a hook flange 6, profiled, for example, in L- or angle form, wherein the two hook flanges 6 are facing one another with their free hook legs and define the open longitudinal gap 7 of the guide channel 5, as can be seen in FIGS. 2 and 3. Inside the guide channel 5 is delimited by a bottom 8 which forms a portion of the guide channel portion 3 at the wing frame 1.

A connecting rod can be pushed in longitudinal direction into the guide channel 5 at the wing frame 1, as is presented in the FIGS. 1 to 3, and 5 of the drawing.

Figures 4, 5:
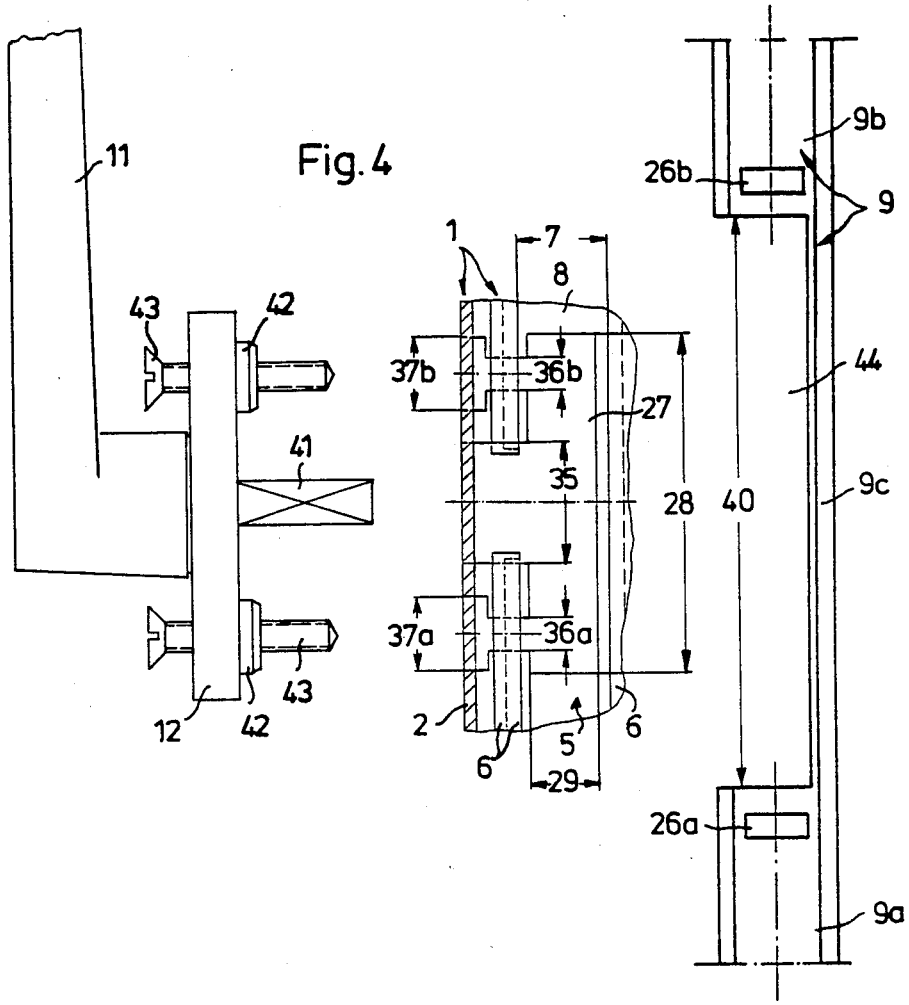
FIG. 4 shows a cut along the line IV—IV in FIG. 1, with an associated control handle before its installation.
FIG. 5 shows a detail from FIG. 1, viewed in the direction of arrow V—V.

An actuation gear assembly 10 is assigned to the wing frame 1 and to the connecting rod 9, which is lengthwise movably taken up in its guide channel 5 and whose features and characteristics are evident from FIGS. 1 to 3. Further, a control handle 11 with a bearing collar 12 is also assigned to the wing frame 3, and to the actuation gear assembly as indicated in FIG. 4 of the drawings.

The actuation gear assembly 10 is provided with a gear housing 13 which contains a pivotable driving element, for example, a pinion 14, stored in a first housing section 15 and a second housing section 16 adjoining thereto in which is guided, lengthwise, a movable clutch slide 17 constantly meshing with the pinion 14.

The second housing section 16 projects in the direction of the guided motion of the clutch slide 17, which guides its movement lengthwise, from the first housing section 15 in which the pinion is stored, in each case in opposite sides by a considerable measure, as is clearly evident from FIG. 1. An extension section 18 also joins to the first housing section 15 (in which is stored the pinion 14) on both sides. In each of these extension sections 18 a threaded engagement 19 is developed.

The threaded engagements 19 have a common axial plane 20—20 with the axis of rotation 21 of the pinion 14 supported in the first housing section 15 as can readily seen in FIG. 1, of the drawing. This axial plane 20—20 lies parallel to the longitudinal direction of the second housing section 16 of the gear housing 13, which guides the clutch slide 17 in lengthwise motion.

The bilateral projecting arms **16*a* and 16*b*, of the second housing section 16 project in each case beyond the extension sections 18 of the first housing section 15, by a measure which is dimensioned slightly greater than the maximal regulating distance for the clutch 17 within the housing section 16. The clutch slide 17 has at both ends, in each case, a lug extension 17*a* or 17*b* which is rearward directed and which constantly projects from a slotted opening in the second housing section 16 of the actuation gear which guides it, as can be seen in FIG. 1**.

From FIG. 1 it can be further seen that the cross-sectional height 22 of the second housing section 16 (serving for the guidance of the clutch slide 17) is dimensioned considerably smaller than the total cross-sectional height 21 of the entire gear housing 13. The cross-sectional height 22 of the housing section 16 should maximally correspond to one third of the total cross-sectional height 23 of the gear housing 13 and amount to about 10 mm.

In the FIGS. 1 to 3 of the drawing it can further be seen that the second housing section 16 of the actuation gear 13 guiding the clutch slide 17 has, at least at its ends, bilaterally projecting supporting claws 24 which are preferably formed onto its projecting arms **16*a* and 16*b*** in one piece.

In the FIGS. 1 and 2 it can further be seen that the first housing section 15 of the actuation gear 13 (supporting the pinion 14) bears upon one side a projecting neck 25 aligned with the axis of rotation 21 of the pinion 14 which neck is advantageously formed in one piece onto the gear housing 13.

It has been found preferable to assemble the gear housing 13 out of two half-shells abutting against each other and lying upon the central plane of the pinion 14 and perpendicular to the axis of rotation 21. These half-shells can preferably be fabricated as shaped parts out of die-cast metal, in which only one of these half-shells is provided with the molded-on neck 25. Both half-shells are either screwed, riveted together, or wedged together after the insertion of the pinion 14 and of the clutch slide 17. In each case one of the two half-shells forms in one piece, one half of the first housing section 15 and one half of the second housing section 16, and of the projecting arms **16*a* and 16*b* of the gear housing 13**.

As already mentioned above, as connecting rod 9 is arranged to be movable in longitudinal direction in the undercut channel 5 of the wing frame 1. It is pushed lengthwise into the guide channel 5 as has likewise been describe further above.

In order that the connecting rod 9 can be coupled with the lug extensions **17*a* and 17*b* when the actuation gear assembly 10 is mounted at the wing 1, the rod is provided with lug recesses 26*a* and 26*b*, which are provided, for example, as transverse slots, as can be learned in particular from the FIG. 5**.

The proper or the functionally correct mounting of the actuation gear assembly 10 at the wing frame 1, requires special precautions. It is thus necessary to provide a perforation 27 where the pinion 14 supported in the housing section 15 of the gear housing 13 comes to rest at the metal or plastics profile of the wing frame 1 at the bottom 8 of the guide channel 5. For example, a recess or milling (FIGS. 2–4) whose length 28 corresponds at least to the length of the housing section 15 plus the adjoining extension sections 18 may be provided. The width 29 of this perforation 27 should be somewhat greater than the thickness 30 of the first housing section 15 and the extension sections 18, but should not exceed the width of the open longitudinal gap 7 of the guide channel 5.

In the exemplified embodiment present in the drawing the width 29 of the perforation 27, is dimensioned smaller than the width of the longitudinal gap 7 at the guide channel 5.

The installation of the actuation gear assembly 10 into the wing frame 1 requires furthermore that three holes 32, **33*a*, and 33*b* are arranged from the roomward face 31 of the wing frame 1. These are provided, for example, as boreholes, whose center axis have a common axial plane 34—34 which extends parallel to the longitudinal direction of the guide channel 5, and lies approximately upon the center of the thickness of the bottom 8 to the guide channel 5, as can be seen from FIG. 1**.

The forming of the holes 32, **33*a*, and 33*b* as boreholes allows their simultaneous construction with the aid of the so-called triple boring and milling head. The drill or miller for making the hole 32 is so designed that with its maximal diameter it severs a cutout 35 from the bottom 8 of the guide channel 5, which cutout extends into the perforation 27 as may be clearly seen in FIG. 4**.

On the other hand, the drilling or milling tools for making the holes **33*a* and 33*b* are designed in a "stepped-down" shape so that they form (on the one hand) in the bottom 8 of the guide channel 5 only relatively small cutouts 36*a* and 36*b* ending in the perforation 7 (FIG. 4), but (on the other hand) make cutouts 37*a* and 37*b*, at least, slightly beyond the thickness of the roomward profile wall. The width of these cutouts correspond to the diameter of the holes 33*a* and 33*b***.

From the FIG. 2 can be learned that in the region of the hole 32 not only the bottom 8 of the guide channel 5 is cut off, but also the hook flange 6 adjacent to the transverse section 2.

However, in the range of the holes **33*a* and 33*b*, the associated hook flange 6 is penetrated only in the section that is directed at right angle to the bottom 8, as shown in FIG. 4, because in this area the drilling or milling tool has reduced diameter for making the cutouts 36*a* and 36*b***.

When the actuation gear assembly 10 with its first housing section 15 and the extension section 18 is pushed from the guide channel face 4 into the perforation 27, then the axial plane 20—20 comes into superimposition with the axial plane 34—34, i.e., the axis of rotation 21 of the pinion 14 assumes axial alignment position with the hole 32, while simultaneously the threaded engagements 19 come into axial alignment position with the holes 33*a* and 33*b*. However, the neck 25 at the gear housing 13 also then comes into axial alignment position with the hole 32, so that it comes to rest in the area of the cutout 35 and of the hook flange 6 penetrated by it. This is shown in FIG. 2, inside the profile section to the wing frame by means of dot-dash lines. The projecting arms 16*a* and 16*b* of the gear housing 13 forming the second housing section 16 come to rest with their supporting claws 24 upon the front face of the mutually facing free legs of the hook flange 6 and thereby limit the insertion depth of the first housing section 15 into the perforation 27.

To secure the actuation gear assembly in its fitting position at the wing frame 1, a plug socket 38 can now be introduced from the roomward face 31 of the wing frame 1 to the hole 32 in such a way that it embraces the neck on the gear housing 13 with a snug fit. By this, the actuation gear assembly 10 is already fixed in its proper fitting position relative to the wing frame 1.

The plug socket 38 can suitably consist of plastics material and have a collar 39 with which it is braced in its plug-in position upon the roomward face 31 of the wing frame 1. The plug socket 38 should also engage at its circumference as much as possible with snug fit—but, optionally, with an elastic catch.

It is quite within the frame of the invention to interrupt the connecting rod 9 in the installation zone of the actuation gear assembly and to couple the two connecting rod partial pieces 9*a* and 9*b* through their lug recesses 26*a* and 26*b* (formed as transverse slots) by means of the two lug extensions 17*a* and 17*b*. However, it has been found in practice, particularly advantageous when the connecting rod 9 is constructed in one piece; that is, when a direct connection 9*c* is retained between the two connecting rod sections 9*a* and 9*b*.

For this purpose the connecting rod 9 is provided with a notch 44 whose length 40 is dimensioned longer (by the maximal regulating distance of the clutch slide 17 in the actuation gear 10) than the length 28 of the perforation 27 in the bottom 8 of the guide channel 5. On the embodiment shown the notch 44 in the connecting rod 9 is designed to be open on one side so that a connection 9*c* exists only at a longitudinal rim of the connecting rod. Deviating from this there can naturally also be taken steps through which the notch 44 is limited on both longitudinal rims of the connecting rod 9 through a connection similar to 9*c*.

In the fitting position of the actuation gear assembly 10 secured by the plug socket 38, the windows and doors can be stored and transported without the control handle 11 with its bearing collar 12 being mounted at the wing frame 1. Only as occasion demands is it necessary that the control handle 11 be mounted over its bearing collar 12 at the wing frame 1 and that the pinion 14 of the actuation gear 10 be coupled through its multi-sided arbor 41. When putting the control handle 11 upon the wing frame its multi-sided arbor 41 enters first into the associated multi-sided nut of the pinion 14. Subsequently the locating plugs 42 provided at the underside of the bearing collar 12 enter into the holes 33*a* and 33*b* or the adjoining cutouts 37*a* and 37*b* for a holding engagement and thereby secure the bearing collar 12 against undesired twisting.

Now it is only necessary that the fastening screws 43 be turned through the holes existing in the bearing collar 12 into the threaded engagements 19 at the gear housing 13 in order to ensure the durable action of the control handle 11 with the actuation gear assembly 10.

The plug socket 38 need not be removed to mount the control handle 11 and the bearing collar 12 because it is readily penetrated by the multi-sided arbor 41, and its supporting collar finds room without any problem in the free space at the underside of the bearing collar 12.

Figure 6:
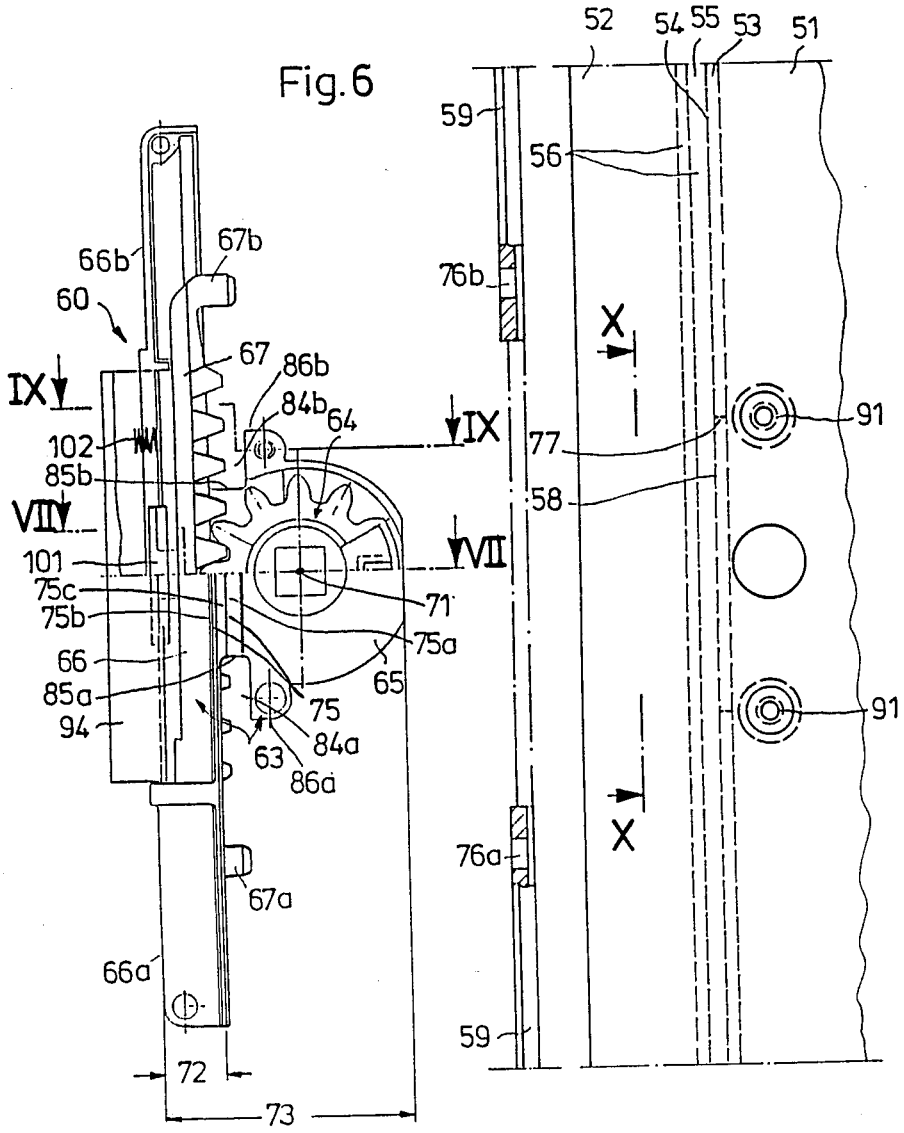
FIG. 6 shows, in front view, a cutout area from the wing frame of a window, a door, or the like, with associated actuation gear assembly of a connecting rod fitting before installation into the wing frame, in modified design.

In FIG. 6 of the drawing there is shown only that cutout section of the wing frame 51 from a window, a door, or the like (which customarily consist of a stationary frame and a wing frame) which is essential for the present case.

The wing frame 51 is in this case composed of metal or plastics profiles which have been fabricated through pressing or extruding. It is preferable to fabricate the wing frame 51 of light-metal profiles which display a face 52 directed parallel to the plane of the wing, and which is joined—essentially under a right angle—by a guide channel section 53. This is evident from FIG. 10, and also from FIGS. 7 and 8. This guide channel section 53 is formed by a profiled wall at the outside of which, the so-called guide channel face 54, is provided a profiled guide channel, open on one side, but bilaterally undercut in transverse direction. The guide channel 55 is limited on both sides by an L- or angle-shaped hook flange 56, whereby the two hook flanges 56 are facing towards one another with their free hook legs and delimit an open lengthwise gap 57 of the guide channel 55 as can be seen from the FIGS. 7 to 9. At the inside, the guide channel 55 is delimited by a bottom 58 which forms a portion of the guide channel section 53 at the wing frame 51.

Into the guide channel 55 at the wing frame 51 connecting rods 59 can be pushed in longitudinal direction. These are presented on the whole only in diagram form in FIG. 6 of the drawing.

An actuation gear assembly 60 is assigned to the wing frame 51 and the connecting rods 59 which are taken up and movable lengthwise in its guide channel 55. A control handle 61 indicated in FIG. 9 with a bearing collar 62, is assigned to the wing frame 51 and to the actuation gear assembly 60 installed therein.

The actuation gear assembly 60 has a gear housing 63 in which is supported a pivotable driving element, for example, a pinion 64, within a first housing section 65. This is adjoined by a second housing section 66 in which a clutch slide 67 is lengthwise movably guided, permanently meshing with the pinion 64.

The second housing section 66 (which lengthwise movably guides the clutch slide 67) projects beyond the first housing section 65 (which stores the pinion 64) in opposite sides in the direction of the guide motion of the clutch slide 67, in each case, by a considerable measure and forms bilateral projecting arms 66*a* and 66*b*, as can be clearly seen in FIG. 6.

The bilateral projecting arms 66*a* and 66*b*, of the second housing section 66 both have a length which is dimensioned greater by a minimum measure than the maximal regulating distance for the clutch slide 67 within the second housing section 66. The clutch slide 67 is provided at both ends with a lug extension 67*a* or 67*b* which is rearward directed and which in each case constantly projects from a slotted opening in the second housing section 66 of the actuation gear assembly 60 guiding it, as is evident from FIG. 6.

From FIG. 6 it can, however, also be seen that the cross-sectional height 72 of the second housing section 66 serving for the guidance of the clutch slide 67 is dimensioned considerably smaller than the total cross-sectional height 73 of the entire gear housing 63. In the illustrated embodiment the cross-sectional height 72 of the second housing section 66 corresponds approximately to one quarter of the total cross-sectional height 73 of the entire gear housing 63, and amounts to at most 10 mm.

FIGS. 6–9 of the drawings show that profile web pairs 74 and 75 are provided on the gear housing 63 of the actuation gear assembly 60 extending on both longitudinal sides parallel to the guide motion of the clutch slide 67 and laterally projecting from the gear housing 63. The web pairs form in each case an undergrip web 74*a* and 75*a* as well well as an overlap web 74*b* and 75*b*.

While the undergrip webs 74*a* and 75*a* are developed solely in the area of the first housing section 65 of the gear housing 63 storing the pinion 64, the overlap webs 74*b* and 75*b* preferably extend over the whole length of the second housing section 66 guiding the clutch slide 67. The profile web pairs 74 and 75 are brought into operative connection and retaining engagement with the rims at the free hook legs of the hook flanges 56 which delimit the undercut guide channel 55 at both sides in L- or angle formed profiles at the wing frame 51, in a manner which can clearly be seen from FIGS. 7 and 9, of the drawing and as is explained in more detail below.

The gear housing 63 is preferably assembled out of two half-shells abutting against one another and lying perpendicular to the axis of the rotation 71 of the central plane of the pinion 64, which half-shells are made, for example, as shaped parts out of die-cast metal. Both half-shells are either screwed, riveted, or wedged together after insertion of the pinion 64 and of the clutch slide 67. Each one of the half-shells forms (in each case in one piece) one half of the first housing section 65 and half of the second housing section 66, and of the projecting arms 66*a* and 66*b* of the gear housing 63.

As mentioned above, the connecting rods 59 are arranged movable longitudinally in the undercut guide channel 55. They are pushed into the guide channel 55 in their longitudinal direction.

For the purpose of coupling the connecting rod sections 9*a* and 9*b* with the lug extensions 67*a* and 67*b* of the clutch slide 67, the rods are provided with lug cutouts 76*a* or 76*b* which can be formed, for example, of transverse slots.

The proper or functionally correct mounting of the actuation gear 60 at the wing frame 51 requires special precautions. It is thus necessary to provide a perforation 77 where the housing section 65 of the gear housing 63 storing the pinion 64 comes to rest at the metal or plastics profile of the wing frame 51 at the bottom 58 of the guide channel 55 as can be seen especially in FIGS. 7, 8 and 10. This perforation 77 can be produced as a recess or milling the length 78 of which is adapted to the length of the housing section 65. The width 79 of the perforation 77 is dimensioned greater than a spacing 80*b* between the lateral flanks 74*c* and 75*c* delimiting the second housing section 66 in the range of the two profiled web pairs 74 and 75 between the undergrip webs 74*a*, 75*a* and the overgrip web 74*b*, 75*b*.

The width 79 of the perforation 77 is preferably adjusted to correspond to the width of the longitudinal gap 57 between the mutually facing rims of the free hook legs of the L- or angle-shaped profiled hook flanges 56 at the wing frame 51. The thickness 80*c* of the housing section 66 at the gear housing 63 measured across the external flanks 74*d* and 75*d* of the undergrip webs 74*a* and 75*a* of both profile web pairs 74 and 75 is also made to be a certain measure greater than the width 79 of the perforation or than the width of the longitudinal gap 57 in the guide channel 55 of the wing frame 51.

Figure 7:
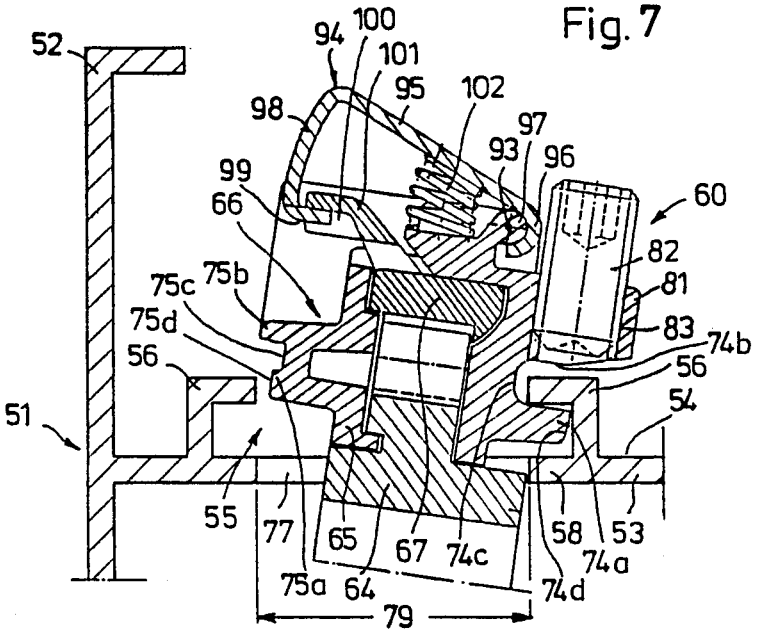
FIG. 7 shows, on a large scale and in cut along the line VII—VII, the front portion of the actuation gear assembly according to FIG. 6, at the start of the installation process into the wing frame.

To install the actuation gear assembly 50 in the wing frame 51 it is first introduced with its housing section 65 through the longitudinal gap 57 of the guide channel 55 into the perforation 77. Then the whole actuation gear assembly 60 is brought into an inclined position against the wing frame 51 (as seen in FIG. 7 of the drawing) in order that first the undergrip web 74*a* of the profile web 74 can be moved under the longitudinal rim at the free hook leg of one of the L- or angle-shaped profiled hook flanges 56 of the guide channel 55. Thereupon the whole gear housing 60 is shifted sideways until the flank 74*c* of the profile web pair 74 abuts, at least approximately, at the longitudinal rim of the respective hook flange 56. Now the gear housing 60 can be pivoted back into a parallel position to the plane of the wing frame 51, whereby also the undergrip web 75*a* of the other profile web pair 75 passes the longitudinal rim of the associated hook flange 56 and comes to lie below the plane to its respective free hook leg. Finally, the gear housing 60 is shifted sideways so that the undergrip web 75*a* grips under the longitudinal rim at the free hook leg of the other associated hook flange 56 (as is evident from FIG. 8 of the drawing). The lateral flank 75*c* of the profile web pair 75 comes to rest in a supporting manner against the longitudinal rim at the free hook leg of the hook flange 56.

Figure 8:
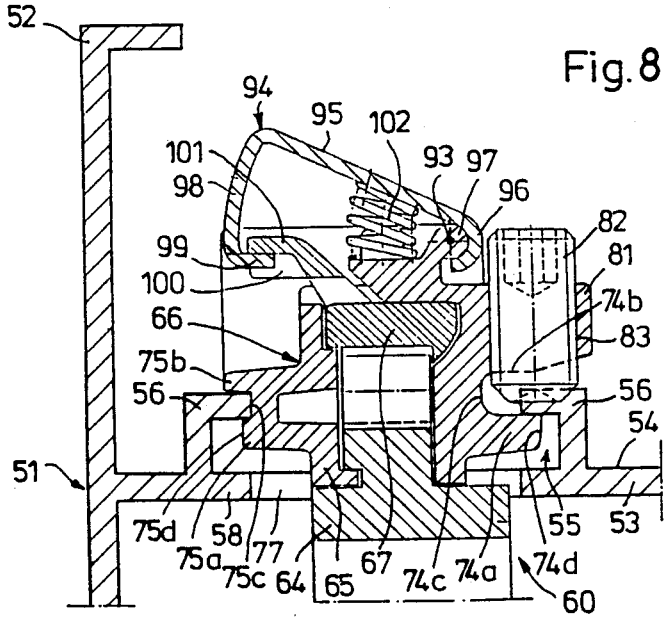
FIG. 8 shows an illustration corresponding to FIG. 7, with, however, the actuation gear installed.
Figure 9:
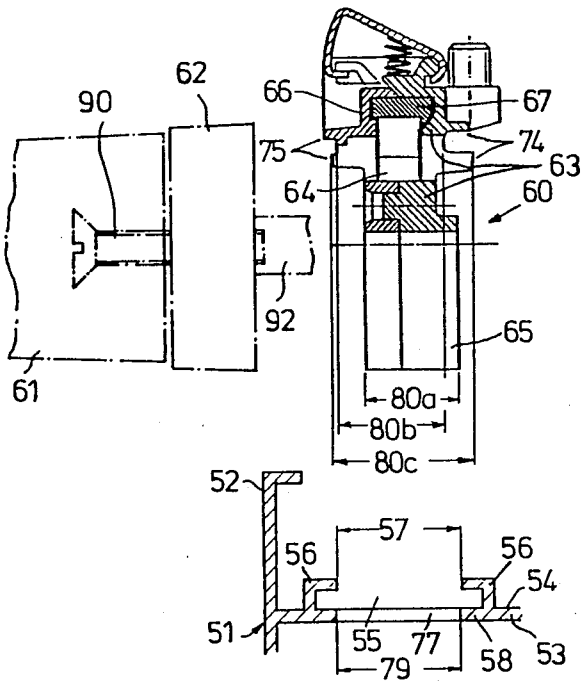
FIG. 9 shows a cut along the line IX—IX, in FIG. 6.

The overlap webs 74*b* and 75*b* of both profile web pairs 74 and 75 are located in this case at the outside of the free hook legs of both hook flanges 56 of the guide channel 55, and serve primarily for a limitation of the engagement depth of the gear housing 60 inside the wing frame 51. At least one overlap web 74*b* of the two profile web pairs 74 and 75 is provided with a laterally projecting shoulder 81 which is equipped with a clamping piece; for example, a clamping screw 82 held in a thread 83. The clamping piece (the clamping screw 82) can be braced at the wing frame 51 against the hook flange 56 interacting with the profile web pair 74 whereby the actuation gear assembly 60 is fixed in its fitting position at the wing frame 51, as shown by FIG. 8.

It is particularly favorable when the clamping piece (for example, the clamping screw 82) is effective in the transverse plane of the actuation gear assembly 60 going through the axis of rotation 71 of the pinion 64, because this then receives a symmetrical positional fixation.

It is also advantageous when the overlap webs 74*b* and 75*b* of the two profile web pairs 74 and 75 display (at least over the length of the first housing section 65) a somewhat greater profile width than the associated undergrip webs 74*a* and 75*a*. At least, at the overlap web 75*b* of the profile web pair 75 a portion of the extent of the lateral flank 75*c* is connected at the second housing section 66 in such a manner that this comes into a lateral support contact over its total length with the longitudinal rim at the free hook leg of the associated hook flange 56 and, thereby, counteracts an angular displacement of the actuation gear 60 around the longitudinal axis of the tightened clamping screw 82 in a reliable manner.

In order that the installation of the actuation gear 60 into the wing frame 1 can be carried out without a problem, it has been found important that the smallest inside spacing between the undergrip web 74a and the overlap web 74b of the profile web pair 74 equipped with the clamping piece (the clamping screw 82) is dimensioned greater than the profile thickness of the free hook leg of the hook web 56. Contrarywise, it is of advantage for a reliable positional fixation of the actuation gear 60 when the smallest inside spacing between the undergrip web 75a and the overlap web 75b of the profile web pair 75 corresponds closely to the profile thickness of the free hook leg of the hook webs 56.

This ensures that the section of the flank 75 which connects at the underside over the whole length of the second housing section 66 at the overlap web 75b permanently remains in positive support engagement with the adjacent longitudinal rim of the free hook leg of the hook web 56.

From FIG. 6 it can further be seen that the first housing section 65 of the gear housing 63 supporting the pinion is bilaterally set off relative to the second housing section 66 guiding the clutch slide 67 to form on each side a claw 84a and 84b. The spacing between the base surfaces 85a and 85b of both claws 84a and 84b is dimensioned smaller than the length 78 of the perforation 77 in the bottom 58 of the guide channel 55.

The claws 84a and 84b are connected directly to the underside of the second housing section 66 or its projecting arms 66a and 66b in such a manner that their openings on the installed actuation gear assembly 60 remain within the guide channel 55. The free end faces 86a and 86b of the claws 84a and 84b of the housing section 65, on the other hand, remain in support engagement with the transverse edges of the perforation 77 in the bottom 58 of the guide channel 55. The longitudinal forces acting upon the gear housing 63 of the actuation gear assembly 60 are, thereby, reliably transferred to the wing frame 51.

Within the guide channel 55, the ends of the connecting rods 9 which are in engagement with the lug extensions 67a and 67b of the clutch slide 67 can be pushed into the claws 84a and 84b. In this way it is possible to reduce the total length of the actuation gear assembly 60 by a measure which corresponds to the total depth of both claws 84a and 84b.

Figure 11:
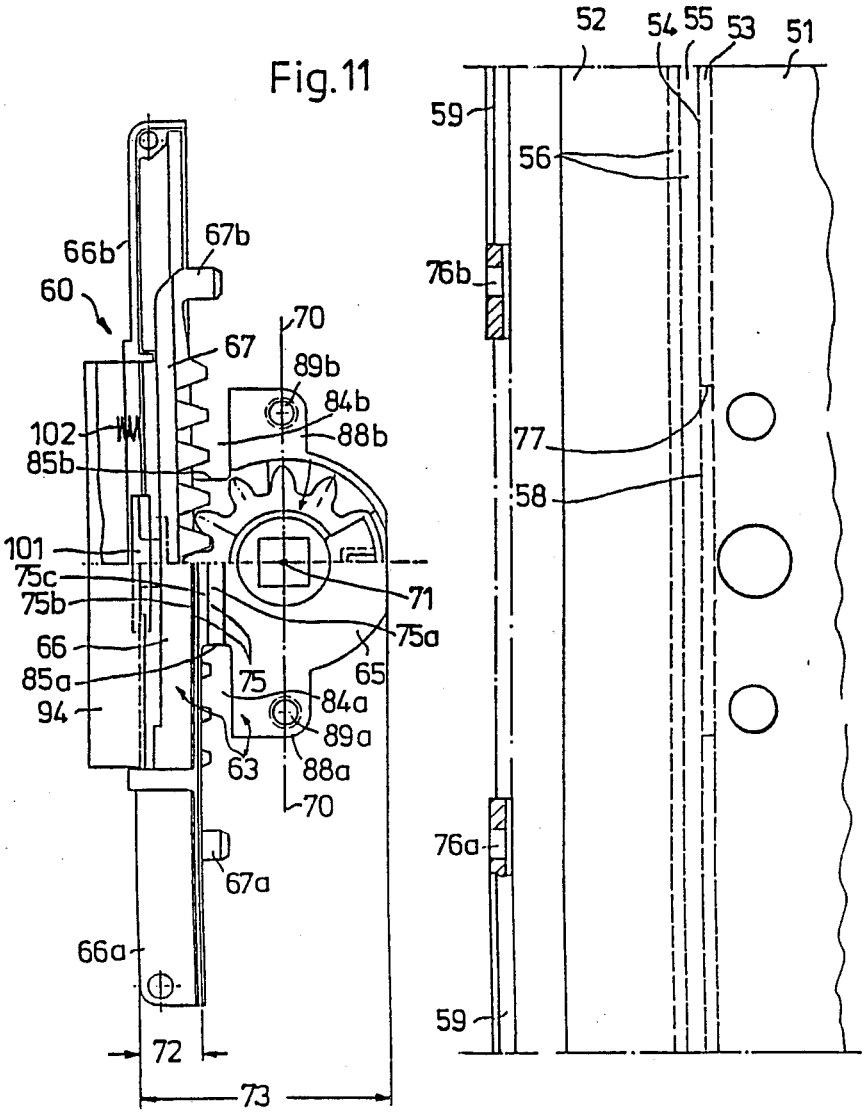
FIG. 11 shows an illustration similar to FIG. 6, with somewhat modified construction of the actuation gear assembly.

In FIG. 11 of the drawing is shown an actuation gear assembly 60 which differs from the one in FIG. 6 only in that an extension section 88a and 88b joins on both sides of the first housing section 65 which stores the pinion 64. In each of the extension sections a threaded engagement 89a or 89b is developed.

Figure 10:
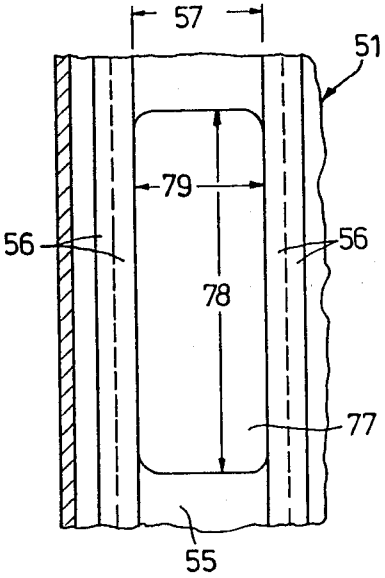
FIG. 10 shows a cut along the line X—X, in FIG. 6.

The threaded engagements 89a and 89b have a common axial plane 70—70 with the rotation axis 71 of the pinion 64 stored in the housing section 65 as shown clearly in FIG. 10. This axial plane 70—70 lies parallel to the longitudinal direction of the housing section 66 of the gear housing 63 which guides the lengthwise movable clutch slide 67.

During operation of the actuation gear assembly 60 according to FIG. 6, the fastening screws 90 for the bearing collar 62 of the control handle 61 are brought into engagement in the threaded bushings 91 which are directly connected as so-called riveting nuts with the wing frame 51. These threaded fasteners 90 can be directly screwed (according to FIG. 11) into the threaded engagement 89a, 89b at the gear housing 63 in order durably to ensure the interaction of the control handle 61 with the actuation gear assembly 60.

The driving connection between the control handle 61 and the pinion 64 of the actuation gear 60 is effected through a multi-sided arbor, preferably a square arbor 92, which is connected by a plug-in engagement with a correspondingly profiled multi-sided nut of the pinion 64.

The second housing section 66 of the actuation gear assembly 60 (lengthwise movably guiding the clutch slide 67) may also carry a blocking rocker 94 tiltably held around an axis 93 lying parallel to its longitudinal axis for use as a misoperation blockage. This blocking rocker 94 has an actuation leg 95 which swingably embraces a housing-firm bearing bead 97, by means of a claw-shaped bearing leg 96.

To the other end of the actuation leg 95 of the blocking rocker 94 a connecting leg 98 joins, which in turn carries at its free end an angular blocking leg 99 which extends in an acute angle to the actuation leg 95. Through the blocking leg 99 the blocking rocker 94 interacts with a blocking engagement element 100 at the underside of an arm 101 projecting from the second housing section 66. The blocking rocker 94 is subjected to the effect of a compression spring 102 braced against the second housing section 66 which seeks to hold the blocking leg 99 in blocking engagement with the blocking engagement element 100. This is always the case when the wing frame 1 is brought into an open position relative to the stationary frame. When, however, the wing frame 51 comes into the closing position relative to the stationary frame, then the actuation leg 95 of the blocking rocker 94 interacts with an actuation stop at the stationary frame. This, then, moves the blocking rocker 94 against the force of the compression spring 102 into such a position that its blocking leg 99 comes out of blocking engagement with the blocking engagement elements 100 at the arm 101. Only then can the clutch slide 67 of the actuation gear assembly 60 be brought into the respective desired switch position through rotary drive of the pinion 64.

Finally, it should be pointed out that instead of the clamping screw 82 as clamping piece for the fixing of the actuation gear 60 of the wing frame 51, clamping parts may also be used which are driven in; for example, between the overlap web 74b and the hook flange 56.

We claim:

1. In a wing frame for a window, door, or the like, where at least the wing frame is a composed of metal or plastics profiles which have a guide channel section provided with a profiled guide channel for the lengthwise taking up a connecting rod, the channel having one open side but bilaterally undercut in the transverse direction wherein the connecting rod located in the guide channel is coupled from the open side to an actuation gear assembly which is provided with a driving element stored in the housing and rotatable by a control handle in which the housing of the actuation gear assembly is held in front of the open side of the guide channel and is fixed there by bolting and wherein the control handle is engaged with a multi-sided arbor in a correspondingly profiled lug recess of the driving element from a roomward face of the wing frame through a hole in the guide channel section and is held in engagement with the driving element by means of bolting, characterized by the fact that the housing of the actuation gear assembly comprises a first housing section (15) and an adjoining second housing section (16), that the metal or plastic profile of the wing frame (1) in the installation range of the actuation gear assembly (10) is provided with a perforation (27) penetrating the bottom (8) of the guide channel (5), that the first housing section (15) of the actuation gear assembly (10) holding the driving element (14) penetrates the perforation (27) while the adjoining second housing section (16) of the actuation gear assembly (10), which lengthwise guides a movable clutch slide (17) which constantly meshes with the driving element (14), is held in front of the open side (7) of the guide channel (5), that the clutch slide is longer by at least the maximal regulating distance of the connecting rod than the length (28) of the perforation (27) in the bottom (8) of the guide channel (5), that the clutch slide (17) is provided with lug extensions (17*a*) and (17*b*) each facing rearwards, and projecting from a slotted opening in the adjoining second housing section (16) of the actuation gear assembly (10) which guides it, which extensions are configured to mesh with corresponding lug recesses (26*a*) and (26*b*) in the connecting rod (9), that the first housing section (15) of the actuation gear assembly (10) which stores the driving element (14) is provided with an engagement thread (19) for threaded fasteners (43) in a plane (20—20) extending parallel to the guide motion of the clutch slide (17) through the axis of rotation (21) of the driving element (14), said fasteners also extending through a bearing collar (12) associated with the control handle (11) which is held on the roomward face (31) of the wing frame (1).

2. The wing frame, according to claim 1, characterized by the fact that the driving element is pinion and that the axis of rotation (21) of the pinion (14) and threaded engagements (19) for the threaded fasteners (43) in the housing (13) of the actuation gear assembly (10) lie upon a plane (20—20) which coincides at least approximately with one half the thickness of the bottom (8) of the guide channel (5).

3. The wing frame, according to claim 1, characterized by the fact that the hole (32) for the passage of the multi-sided arbor (41) of the control handle (11) and the holes (33*a*), (33*b*) for the passage of the threaded fasteners (43) of the bearing collar (12) are drilled holes which penetrate the hook flange (6) of a guide channel (5) up to the perforation (27) in the bottom (8).

4. The wing frame, according to claim 1, characterized by the fact that the adjoining second housing section (16) of the actuation gear assembly guiding the clutch slide (17) is provided with bilaterally projecting supporting claws (24), which can be laid against front face of the hook flanges (6) of the wing frame (1) which define the undercut guide channel (5).

5. The wing frame, according to claim 1, characterized by the fact that the first housing section (15) of the actuation gear assembly (10) which stores the driving element (14) is provided with a projecting neck (25) at the side lying next to the roomward face (31) of the wing frame (1), the neck is aligned with the axis of rotation (21) of the driving element (14) and a plug socket (38) is provided which, with the projecting neck (25), can engage the hole (32) in the wing frame (1) aligned with the roomward face (31) of the wing frame (1).

6. The wing frame, according to claim 5, characterized by the fact that the plug socket (38) bears a collar (39) which is braced upon the roomward face (31) of the wing frame (1).

7. The wing frame, according to claim 1, characterized by the fact that the connecting rod (9) is provided with a notch (44) located in the installation area of the actuation gear assembly (10) of which the length (40) is greater by at least the maximal regulating distance of the clutch slide (17) than the length (28) of the perforation (27) in the bottom (8) of the guide channel (5) and that the notch (44) has a width which is dimensioned greater than the inside width of the opening side or gap (7) of the undercut guide channel (5) and the wing frame (1), while the width (29) of the perforation (27) in the bottom (8) of the undercut guide channel (5) is at most equal to the inside width of the opening side or gap (7) of the channel.

8. The wing frame, according to claim 7, characterized by the fact that the notch (44) in connecting rod (9) is open on one side and that the lug recesses (26*a*, 26*b*) are formed by slotted holes offset from the ends of the notch (44).

9. The wing frame, according to claim 1, characterized by the fact that the bearing collar (12) of the control handle (11) engages with approximate fit in the holes (33*a*, 33*b*) at the roomward face (31) of the wing frame (1) by means of locating plugs (42) molded concentrically at the rear to the axles of the threaded fasteners (43).

10. In a wing frame for a window, door, or the like, where at least the wing frame is composed of metal or plastics profiles which have a guide channel section provided with a profiled guide channel for the lengthwise taking up a connecting rod, the channel having one open side but bilaterally undercut in the transverse direction, wherein the connecting rod located in the guide channel is coupled from the open side to an actuation gear assembly which is provided with a driving element stored in the housing and rotatable by a control handle in which the housing of the actuation gear assembly is held in front of the open side of the guide channel and is fixed there by bolting and wherein the control handle is engaged with a multi-sided arbor in a correspondingly profiled lug recess of the driving element from a roomward face of the wing frame through a hole in the guide channel section and is held in engagement with the driving element by means of bolting, characterized by the fact that the housing of the actuation gear assembly comprises a first housing section (65) and an adjoining second housing section (66), that the metal or plastics profile of the wing frame (51) in the installation range of the actuation gear assembly (60) is provided with a perforation (77), penetrating the bottom (58) of the guide channel (55), that the first housing section (65) of the actuation gear assembly (60) holding the driving element (64) penetrates the perforation (77) while the second housing section (66) of the actuation gear assembly (60), which lengthwise guides a movable clutch slide (67) which constantly meshes with the driving element (64), is held in front of the open side (57) of the guide channel (55) that the length of the clutch slide (67) is longer than the length (78) of the perforation (77) in the bottom (58) of the guide channel (55), that the clutch slide (67) displays bilateral rearwardly directed lug extensions (67*a*, 67*b*) projecting from a slotted opening in the second housing section (66) of the actuation gear assembly (60) which guides it, the lug extensions adapted to mesh with corresponding cutouts (76*a*, 76*b*) at the connecting rod (59), such that pairs of profile webs (74, 75) are provided extending parallel to the guide motion of the clutch slide (67) and spreading laterally from the gear housing (63) in the area of the first housing section (65) of the actuation gear assembly (60) which stores the driving element (64) at both longitudinal sides of the housing (63) forming in each case an undergrip web (74*a*, 75*a*) and an overlap web (74*b*, 75*b*) for the rims of the hook flanges (56) of the guide channel (55), and that one of the overlapping webs (74*b*, 75*b*) is held by a clamping piece (82) under tension against a hook flange (56) of the guide channel (55).

11. The wing frame, according to claim 10, characterized by the fact that, the overlap webs (74*b*, 75*b*) of the pairs of profiled webs (74, 75) extend along the second housing section (66) of the actuation gear assembly (60) guiding the lengthwise motion of the clutch slide (67) over its whole length, while their undergrip webs (74*a*, 75*a*) are located only adjacent the first housing section (65) in which the driving element (64) is supported.

12. The wing frame according to claim 10, characterized by the fact that the distance (80*b*) of the lateral flanks (74*c*, 75*c*) which face away from one another on the pair of profiled webs (74, 75) is dimensioned smaller than the width of the gap (57) between the mutually facing rims of the hook flanges (56) at the guide channel (55), whereby the perforation (77) in the bottom (58) of the wing-side guide channel (55) has a width (79) which is greater at least by the difference of the distances (80*b* and 57) than the maximal thickness (80*a*) of the first housing area (65) of the actuation gear assembly (60) which stores the driving element (64).

13. The wing frame, according to claim 10, characterized by the fact that the portion of the overlap webs (74*b*, 75*b*) of the pairs of profiled webs (74, 75) adjacent the first housing section (65) of the actuation gear assembly (60) which stores the driving element (64) have a greater profile width than the undergrip webs (74*a*, 75*a*).

14. The wing frame, according to claim 10, characterized by the fact that the smallest inside distance between the undergrip webs (74*a*) and the overlap webs (74*b*) of the pair of profiled webs (74) equipped with the clamping piece (82) is dimensionsed greater than the profile thickness of the hook flange (56) rims of the guide channel (55), while the smallest inside distance between the undergrip web (75*a*) and the overlap web (75*b*) of the other pair of profiled webs (75) corresponds closely to the profile thickness of the hook flange (56) rims.

15. The wing frame, according to claim 10, characterized by the fact that the first housing section (65) of the actuation gear assembly (60) storing the driving element (64) is offset bilaterally in longitudinal direction relative to the second housing section (67) guiding the clutch slide (67) in order to form on each side a claw (84*a*, 84*b*), each having base surfaces and free end faces the distance between the base surfaces (85*b*, 85*b*) of both claws (84*a*, 84*b*) is dimensioned smaller than the length (78) of the perforation (77) in the bottom (58) of the wing-side guide channel (55), while the distance between the free end faces (86*a*, 86*b*) of both claws (84*a*, 84*b*) corresponds to the length (78) of the perforation (77).

16. The wing frame, according to claim 15, characterized by the fact that the claw sections (88*a*, 88*b*) of the first housing section (65) of the actuation gear assembly (60) storing the driving element (64) are provided at least upon one side with threaded engagements (89*a*, 89*b*) for threaded fasteners located on a plane (70—70) extending parallel to the guide motion of the clutch (67) and passing through the axis of motion (71) of the driving element, the engagements also penetrating a bearing collar (62) associated with the control handle (61) which is braced at the roomward face of the wing frame (51).

17. The wing frame, according to claim 10, characterized by the fact that the second housing section (66) of the actuation gear assembly (60) which lengthwise guides the movable clutch slide (67) carries a spring-loaded (102) blocking rocker (94) tiltably held by a bearing leg (96) and a bearing bead (97) around an axis (93) which lies parallel to its longitudinal direction, which rocker carries a misoperation blocking mechanism having a blocking leg (99) which can be brought into and out of blocking engagement with blocking engagement element (100) on an arm (101) projecting from the the second housing section (66) associated with the clutch slide (67).

* * * * *